US007644541B2

(12) United States Patent
Piovesan

(10) Patent No.: US 7,644,541 B2
(45) Date of Patent: Jan. 12, 2010

(54) TERMINAL FOR ENAMELED ELECTRIC WIRES

(75) Inventor: Gianni Piovesan, Cadoneghe (IT)

(73) Assignee: Inarca S.p.A., Vigodarzere (IT)

( * ) Notice: Subject to any disclaimer, the term of this patent is extended or adjusted under 35 U.S.C. 154(b) by 0 days.

(21) Appl. No.: 12/010,333

(22) Filed: Jan. 24, 2008

(65) Prior Publication Data

US 2008/0287014 A1 Nov. 20, 2008

(30) Foreign Application Priority Data

Feb. 2, 2007 (IT) ..... PD2007A0033

(51) Int. Cl.
*H01R 13/648* (2006.01)

(52) U.S. Cl. ..... 49/395

(58) Field of Classification Search ..... 439/883, 439/395, 398, 404–409
See application file for complete search history.

(56) References Cited

U.S. PATENT DOCUMENTS

| | | | | |
|---|---|---|---|---|
| 4,836,803 | A * | 6/1989 | Seidel | 439/447 |
| 6,157,542 | A * | 12/2000 | Wu | 361/752 |
| 7,118,404 | B2 * | 10/2006 | Ploesser | 439/398 |
| 7,452,245 | B2 * | 11/2008 | Doorhy et al. | 439/676 |
| 2005/0272299 | A1 * | 12/2005 | Ploesser | 439/395 |

FOREIGN PATENT DOCUMENTS

| | | | |
|---|---|---|---|
| DE | 12 63 130 | B | 3/1968 |
| DE | 20 2005 014816 | U1 | 11/2005 |
| EP | 0 459 144 | A | 12/1991 |
| EP | 0 645 857 | A | 3/1995 |
| EP | 1 521 349 | A | 4/2005 |
| GB | 2 168 858 | A | 6/1986 |

* cited by examiner

*Primary Examiner*—Jean F Duverne
(74) *Attorney, Agent, or Firm*—Modiano & Associati; Albert Josif; Daniel J. O'Byrne

(57) ABSTRACT

A terminal for enameled electric wires, of the type constituted by a plate-like body which forms a connecting fork with tabs which cantilever inward on the same plane of arrangement as the plate-like body; the tabs face each other so as to form a self-centering tapered opening for guiding the insertion of an electric wire with insulating enameling, the wire being adapted to be locked between the ends of the tips of the tabs and an abutment formed on the plate-like body proximate to the ends, with an axis which lies transversely to the arrangement of the plate-like body; the tips form a cut-through slot whose transverse dimensions are smaller than the diameter of the enameled wire, so as to cut through at least its insulating layer during its passage between them and provide electrical contact. At least one of the facing edges of the cut-through tips has a serrated portion in order to scrape and remove the layer of enamel from the surface of the enameled electric wire.

10 Claims, 2 Drawing Sheets

TERMINAL FOR ENAMELED ELECTRIC WIRES

BACKGROUND OF THE INVENTION

Currently known terminals for enameled electric wires are constituted by a plate-like body which forms a connection fork with tabs which cantilever inward on the same plane of arrangement as the plate-like body; the tabs face each other so as to form a tapering self-centering opening for guiding the insertion of an electric wire with insulating enamel, said wire being arranged between the ends of the tips of the tabs and an abutment formed on the plate-like body proximate to the tips, with an axis arranged transversely with respect to the arrangement of the plate-like body; the tips form a slot whose transverse dimensions are smaller than the diameter of the enameled wire, so as to cut through at least its insulating layer during its passage between them and provide the electrical contact at the flat part of the ends of the tips.

Such terminals are applied particularly but not exclusively in the wiring of the windings of electric motors and transformers, electric coils, reactors, actuators and power supplies.

Currently, due to the increase in the cost of copper, enameled conducting wires made of aluminum are increasingly widespread.

However, aluminum is softer than copper, and the passage of an enameled aluminum wire between the cut-through tips of a terminal of a known type often causes only the deformation of the aluminum core of the enameled wire, reducing the resisting cross-section, without however cutting through the insulating covering layer; when this occurs, electrical contact between the conducting wire and the terminal does not occur, and the provided electrical connection is substantially unusable.

SUMMARY OF THE INVENTION

The aim of the present invention is to provide a terminal for enameled electric wires which solves the drawback shown by known types of connector.

Within this aim, an object of the present invention is to provide a terminal which is capable of cutting through even enameled electric wires in which the conductor is made of a metallic material softer than copper.

Another object of the present invention is to provide a terminal which can be used for the same applications for which similar connectors of a known type are designed, without having to act at all on the elements that support it or on the assembly equipment.

Another object of the present invention is to provide a terminal which can be manufactured cheaply with known systems, equipment and technologies.

This aim and these and other objects, which will become better apparent hereinafter, are achieved by a terminal for enameled electric wires, of the type constituted by a plate-like body which forms a connecting fork with tabs which cantilever inward on the same plane of arrangement as the plate-like body, said tabs facing each other so as to form a self-centering tapered opening for guiding the insertion of an electric wire with insulating enameling, said wire being adapted to be arranged between the ends of the tips of said tabs and an abutment formed on said plate-like body proximate to said tips, with an axis which lies transversely to the arrangement of the plate-like body, said tips forming a cut-through slot whose transverse dimensions are smaller than the diameter of the enameled wire, so as to cut through at least its insulating layer during its passage between them and provide electrical contact, said terminal being characterized in that at least one of the facing edges of said cut-through tips is serrated in order to scrape and remove the layer of enamel from the surface of the enameled electric wire.

BRIEF DESCRIPTION OF THE DRAWINGS

Further characteristics and advantages of the invention will become better apparent from the following detailed description of two preferred but not exclusive embodiments thereof, illustrated by way of non-limiting example in the accompanying drawings, wherein.

DESCRIPTION OF THE PREFERRED EMBODIMENTS

Figure 1:
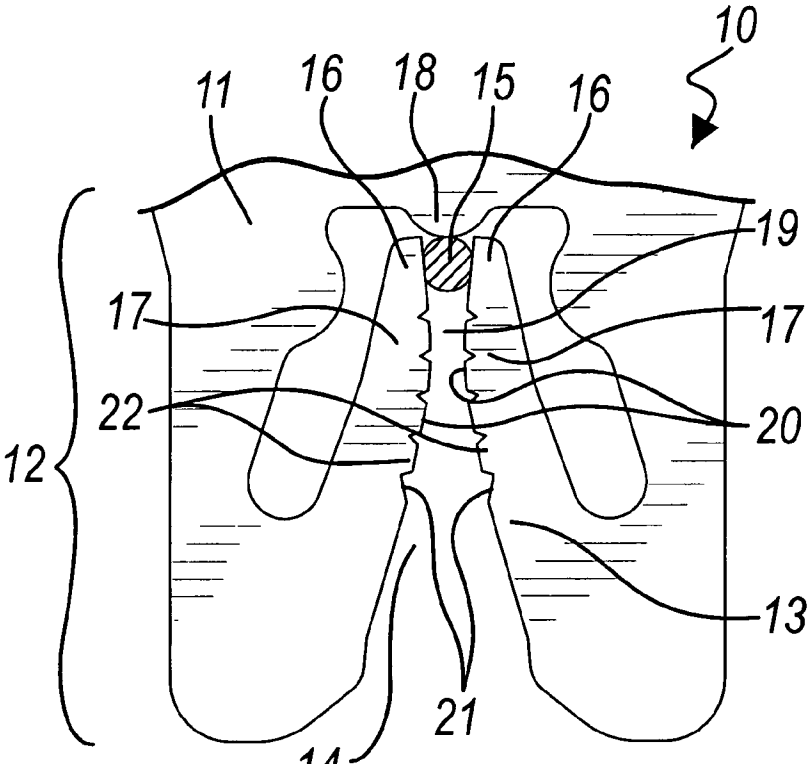
FIG. 1 is a front view of a terminal according to the invention in a first embodiment thereof.

With reference to the figures, a terminal for enameled electric wires according to the invention is generally designated by the reference numeral 10 in its first embodiment of FIG. 1.

The terminal 10 is of the type constituted by a plate-like body 11, which forms a connecting fork 12, which is provided with tabs 13 which cantilever inward on the same plane of arrangement as the plate-like body 11.

The tabs 13 face each other so as to form a self-centering tapered opening 14 for guiding the insertion of an electric wire 15 with insulating enameling.

The wire 15 is locked between ends 16 of tips 17 of the tabs 13 and an abutment 18 formed on the plate-like body 11 proximate to the ends 16 of the tips 17.

The wire 15 is arranged so that its axis is transverse with respect to the arrangement of the plate-like body 11.

The tips 17 form a cut-through slot 19 whose transverse dimensions are smaller than the diameter of the enameled wire 15, so as to cut through at least its insulating layer during its passage between the tips and provide electrical contact.

In the present non-limiting and exemplifying embodiment of the invention, the two facing edges of the cut-through tips 17 have a serrated portion 20 for scraping and removing the layer of enamel from the surface of the enameled electric wire 15.

The serrated portion 20 can be provided inherently with the blanking of the entire terminal 10 from a metal plate, by means of a contoured punch, or, as an alternative, can be provided after blanking the plate-like body 11 from a metal plate, by scraping the edges of the cut-through tips 17 with a contoured punch.

The serrated portion 20 is provided so as to have grooves which form through hollows 21, i.e., hollows which affect the tips 17 over their entire thickness.

Figure 3:
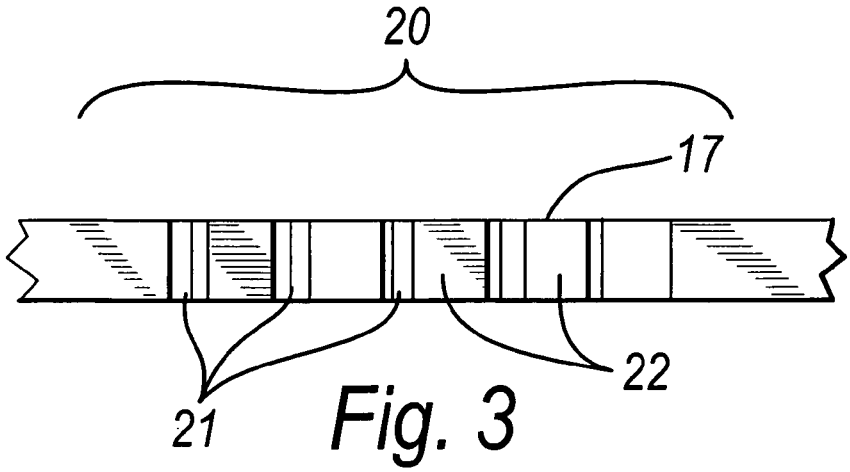
FIG. 3 is a schematic side view of a serrated portion of the terminal according to the invention.

Such grooves are provided at right angles to the arrangement of the plate-like body 11 of the terminal 10, as clearly shown in FIG. 3.

Figure 4:
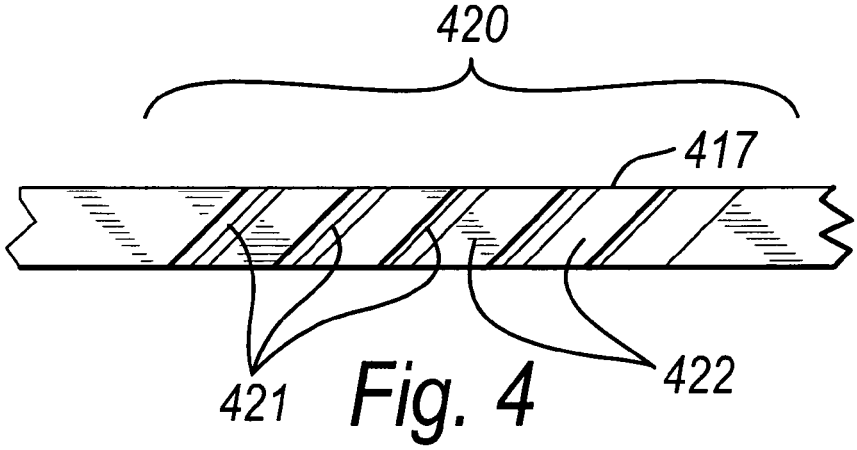
FIG. 4 is a schematic side view of another embodiment of the serrated portion provided on the terminal according to the invention.

FIG. 4 shows another embodiment of the serrated portion, here designated by the reference numeral 420, in which the grooves 421 are oblique with respect to the arrangement of the plate-like body, and teeth 422 are inclined with them.

The serrated portions 20 are provided by a series of teeth 22 which have sharp edges or only slightly rounded edges and are formed, as mentioned, either by means of a scraping operation after blanking the entire terminal 10 from a metal plate or directly by blanking; each tooth 22 protrudes between two hollows 21 toward the facing edge of the facing cut-through tip 17.

It should be understood that the teeth 22 can be provided in any number at will according to requirements.

Figure 2:
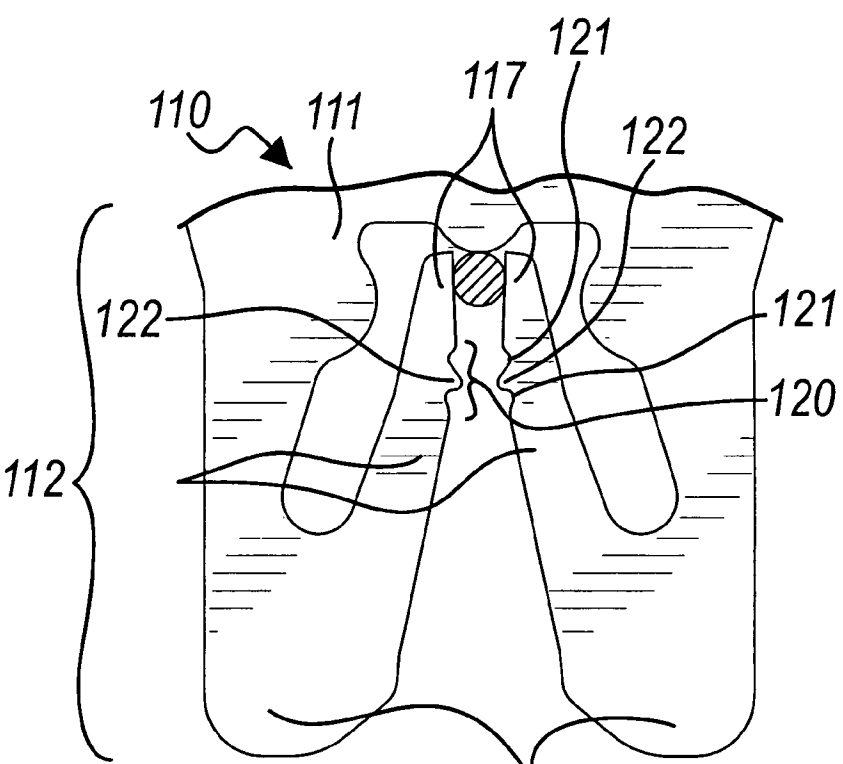
FIG. 2 is a front view of the terminal according to the invention in a second embodiment thereof.

FIG. 2 shows the terminal according to the invention in its second embodiment, which also is an exemplifying and non-limiting embodiment of the invention, and is designated therein by the reference numeral 110.

The view of FIG. 2 clearly illustrates the plate-like body 111, the tabs 113 of the fork 112, and the cut-through tips 117; the serrated portion 120 is shown, by way of non-limiting example, on each edge of the tips 117 as being constituted by a single tooth 122 which protrudes between two hollows 121.

In this case also, the teeth 122 can be provided either inherently with the blanking of the entire terminal 110 from a metal plate or by scraping after blanking.

Similarly to what has been described above, it is understood that the serrated portion 120 can be provided with any number of teeth, the embodiment with a single tooth 122 being merely a non-limiting example of the invention.

Figure 5:
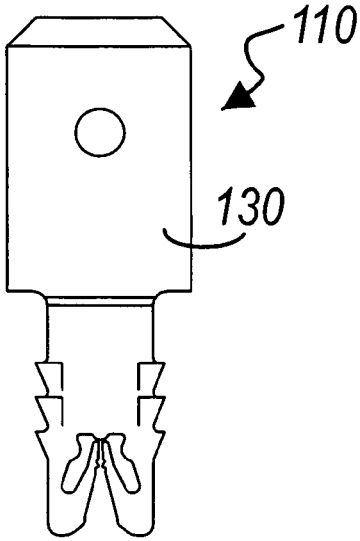
FIGS. 5 to 7 are views of three different configurations of the same terminal in its second embodiment.
Figure 6:
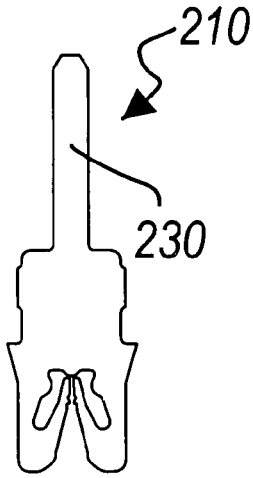
Figure 7:
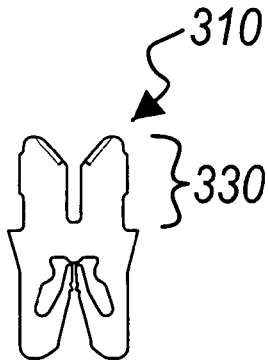

FIG. 5 is a view of the terminal 110 according to the invention in the variation with a spade contact 130; FIG. 6 illustrates a second variation of a terminal 210 with a pin-shaped contact 230; and FIG. 7 illustrates a third variation 310 of the second embodiment of the terminal 110, with a fork-shaped contact 330 for a power supply cable.

In practice it has been found that the invention thus described solves the problems noted in known types of connector for enameled electric wires.

In particular, the present invention provides a terminal which is capable of cutting through even enameled electric wires in which the conductor is made of a metallic material which is softer than copper.

This is the case of enameled aluminum electric wires, from the surface of which the terminal 10 and 110 according to the invention is capable of removing the enamel by means of the serrated portions 20, 120 or 420 with which the edges of the cut-through tips 17 and 117 are provided.

Moreover, the present invention provides a terminal which can be used for the same applications for which similar connectors of a known type are designed, without having to affect at all the elements that support it or the assembly equipment.

Moreover, the present invention provides a terminal which can be manufactured cheaply with known systems, equipment and technologies.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2007A000033 from which this application claims priority are incorporated herein by reference.

What is claimed is:

1. A terminal for enameled electric wires, of the type constituted by a plate-like body which forms a connecting fork with tabs which cantilever inward on a same plane of arrangement as the plate-like body, said tabs facing each other so as to form a self-centering tapered opening for guiding insertion of an electric wire with insulating enameling, said wire being adapted to be locked between ends of tips of said tabs and an abutment formed on said plate-like body proximate to said ends, with an axis which lies transversely to an arrangement of the plate-like body, said tips forming a cut-trough slot whose transverse dimensions are smaller than a diameter of the enameled wire, so as to cut through at least an insulating layer of the wire during its passage between them and provide electrical contact, wherein at least one of facing edges of said cut-through tips has a serrated portion in order to scrape and remove a layer of enamel from a surface of the enameled electric wire, the terminal further comprising a serrated portion for each of the facing edges of the cut-through tips, and said serrated portion being provided with grooves which form through hollows which affect the tips through their entire thickness.

2. A terminal for enameled electric wires, of the type constituted by a plate-like body which forms a connecting fork with tabs which cantilever inward on a same plane of arrangement as the plate-like body, said tabs facing each other so as to form a self-centering tapered opening for guiding insertion of an electric wire with insulating enameling, said wire being adapted to be locked between ends of tins of said tabs and an abutment formed on said plate-like body proximate to said ends, with an axis which lies transversely to an arrangement of the plate-like body, said tins forming a cut-through slot whose transverse dimensions are smaller than a diameter of the enameled wire, so as to cut through at least an insulating layer of the wire during its passage between them and provide electrical contact, wherein at least one of facing edges of said cm-through tins has a serrated portion in order to scrape and remove a layer of enamel from a surface of the enameled electric wire, the terminal further comprising a serrated portion for each of the facing edges of the cut-through tips, and said serrated portion being provided, after blanking the plate-like body from a metal plate, by scraping the edges of the cut-though tips with a contoured punch.

3. The terminal of claim 1, wherein said serrated portion is provided inherently with a blanking of said entire terminal from a metal plate by means of a contoured punch.

4. A terminal for enameled electric wires, of the type constituted by a plate-like body which forms a connecting fork with tabs which cantilever inward on a same plane of arrangement as the plate-like body, said tabs facing each other so as to form a self-centering tapered opening for guiding insertion of an electric wire with insulating enameling, said wire being adapted to be lacked between ends of tins of said tabs and an abutment formed on said plate-like body Proximate to said ends, with an axis which lies transversely to an arrangement of the plate-like body, said tins forming a cut-through slot whose transverse dimensions are smaller than a diameter of the enameled wire, so as to cut through at least an insulating layer of the wire during its passage between them and provide electrical contact, wherein at least one of facing edges of said cut-through tips has a serrated portion in order to scrape and remove a layer of enamel from a surface of the enameled electric wire, the terminal further comprising a serrated portion for each of the facing edges of the cut-through tips, and said serrated portion being provided by at least one removal tooth which protrudes between two hollows toward the facing edge of the facing cut-through tip.

5. The terminal of claim 1, wherein said grooves are provided at right angles to the arrangement of the plate-like body of the terminal.

6. The terminal of claim 1, wherein the grooves of the serrated portion are oblique with respect to the arrangement of the plate-like body, and the teeth are also inclined with them.

7. The terminal of claim 4, wherein said serrated portion is provided with grooves which form through hollows which affect the tips though their entire thickness.

8. The terminal of claim 4 wherein on each edge, said serrated portion is formed by a series of teeth with sharp or slightly rounded edges, which are provided either by means of a scraping operation alter blanking the entire said terminal from a metal plate or inherently with said blanking.

9. The terminal of claim 4, wherein on each edge, said serrated portion is provided by a single tooth which protrudes between two hollows, said single toot of each edge being provided either inherently with the blanking of the entire said terminal from a metal plate or by scraping after blanking.

10. The terminal of claim 9, wherein the teeth can. be provided in any number at will according to requirements.

* * * * *